US009133985B1

(12) United States Patent
Sues

(10) Patent No.: US 9,133,985 B1
(45) Date of Patent: Sep. 15, 2015

(54) STORAGE CONTAINER WITH A REGENERATIVE INERT ENVIRONMENT

(71) Applicant: James R. Sues, Newtown, PA (US)

(72) Inventor: James R. Sues, Newtown, PA (US)

( * ) Notice: Subject to any disclaimer, the term of this patent is extended or adjusted under 35 U.S.C. 154(b) by 218 days.

(21) Appl. No.: 13/900,522

(22) Filed: May 22, 2013

Related U.S. Application Data

(60) Provisional application No. 61/650,743, filed on May 23, 2012.

(51) Int. Cl.
*B65D 79/00* (2006.01)
*F17C 1/00* (2006.01)

(52) U.S. Cl.
CPC ..... *F17C 1/00* (2013.01)

(58) Field of Classification Search
CPC ..... B65B 31/00; A23L 3/0155; A23B 7/144
USPC ..... 206/527, 0.6, 0.7, 528, 524.8; 99/472–474, 467; 426/112, 115, 118, 426/595; 126/25 R
See application file for complete search history.

(56) References Cited

U.S. PATENT DOCUMENTS

| | | | | |
|---|---|---|---|---|
| 8,261,732 | B2 * | 9/2012 | Contarino, Jr. | 126/25 R |
| 8,282,134 | B2 * | 10/2012 | Cavagna | 285/1 |
| 2002/0148459 | A1 * | 10/2002 | McCarty et al. | 126/25 R |
| 2005/0092315 | A1 * | 5/2005 | Bachelder | 126/25 R |
| 2007/0034199 | A1 * | 2/2007 | Chung | 126/25 R |
| 2008/0000468 | A1 * | 1/2008 | Pai | 126/25 R |
| 2012/0167867 | A1 * | 7/2012 | Fisher et al. | 126/25 R |
| 2012/0247448 | A1 * | 10/2012 | Thibodeaux | 126/25 R |

* cited by examiner

*Primary Examiner* — Luan K Bui
*Assistant Examiner* — Rafael Ortiz
(74) *Attorney, Agent, or Firm* — LaMorte & Associates, P.C.

(57) ABSTRACT

A container assembly that can store items in an inert environment. The container assembly is rechargeable so that the inert environment can be repeatedly reestablished. The storage container has a base. The base has a top surface with at least one gas port. A gas charging system is disposed within the base. The gas charging system includes a piercing projection for piercing a gas cartridge. The gas charging system also includes a conduit that leads from the piercing projection to the gas ports, and a fill valve for selectively controlling gas flow through the conduit. A tubular wall is affixed to the base. A removable closure is selectively attached to the open top end of the tubular wall to provide access to the storage compartment. A release valve is provided in the closure that enables gas to exit the storage compartment.

18 Claims, 3 Drawing Sheets

STORAGE CONTAINER WITH A REGENERATIVE INERT ENVIRONMENT

RELATED APPLICATIONS

This application claims the benefit of U.S. Provisional Patent Application No. 61/650,743 entitled, System And Method For Storing Coffee In An Inert Environment.

BACKGROUND OF THE INVENTION

1. Field of the Invention

In general, the present invention relates to storage containers capable of holding a volume of coffee beans or ground coffee. More particularly, the present invention relates to portable containers where air within the container can be selectively displaced with an inert gas during periods of storage.

2. Prior Art Description

After coffee beans are roasted, they contain many complex compounds that add to the flavor and aroma of the coffee made from those beans. However, many of these compounds can oxidize or otherwise react with air when the coffee is left exposed to air. This can cause the coffee to lose its flavor notes and become stale. This is one of the main reasons why coffee beans and ground coffee are typically packaged in air tight bags or cans.

It has been found that coffee can be kept fresher for longer if the coffee is stored in a container that is devoid of air. In the prior art, there are many coffee cans, jars and packages that are sold "vacuum packed". That is, excess air has been removed from the packaging just before the packaging is sealed closed. Of course, the vacuum seal is broken once the packaging is open. Thus, any coffee left in the packaging becomes exposed to air and begins to oxidize and become stale.

In the prior art, there are many types of packaging that can be resealed. Some of this packaging can be squeezed prior to sealing to remove excess air. However, all of the air cannot be removed. Once packaging is open and coffee becomes exposed to air, some air will always remain trapped with the coffee as the coffee is stored. This causes the coffee to oxidize and become stale. The amount of air trapped with the coffee depends upon the state of the coffee. Large spaces exist between large coffee beans. These spaces are capable of retaining a significant amount of air. Ground coffee that is ground and tightly packed holds less air. However, since the coffee is ground, the smaller coffee particles oxidize more readily and less air is required to make the coffee stale.

A need therefore exists for a way to package coffee that eliminates air from around the coffee, therein preventing it from oxidizing. A need also exists for a packaging system that can enable coffee to be repeatedly taken from a container and used, wherein the coffee that remains in the container is isolated from air. In this manner, coffee can be stored for much longer periods of time without becoming stale. Lastly, a need exists for packaging that can be used to keep coffee isolated from air regardless of whether the coffee is ground or is in its original bean form. These needs are met by the present invention as described and claimed below.

SUMMARY OF THE INVENTION

The present invention is a container assembly that can store items in an inert environment. The container assembly is rechargeable so that the inert environment can be reestablished after each time the storage container is opened. The storage container has a base. The base has a top surface with at least one gas port. A gas charging system is disposed within the base. The gas charging system includes a piercing projection for piercing a gas cartridge. The gas charging system also includes a conduit that leads from the piercing projection to the gas ports, and a fill valve for selectively controlling gas flow through the conduit.

A tubular wall is affixed to the base. The tubular wall extends above the top surface of the base. The tubular wall and the base combined to define a storage compartment. A removable closure is selectively attached to the open top end of the tubular wall to provide access to the storage compartment. A release valve is provided in the closure that enables gas to exit the storage compartment.

To use the assembly, the closure is removed and items are placed in the storage compartment. The closure is again secured and inert gas is released into the storage compartment. The incoming inert gas displaces air out of the storage compartment through the release valve. The storage compartment is then filled with an inert gas.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention container assembly can be configured in many ways and can be used to hold many products other than coffee, the present invention is especially well suited for storing coffee. Consequently, the present invention container system is illustrated and described as a container sized to hold a pound of coffee. The shown embodiment therefore presents one of the best modes contemplated for the invention. However, the illustrated embodiment is intended to be exemplary and should not be considered a limitation when interpreting the scope of the appended claims.

Figure 1:
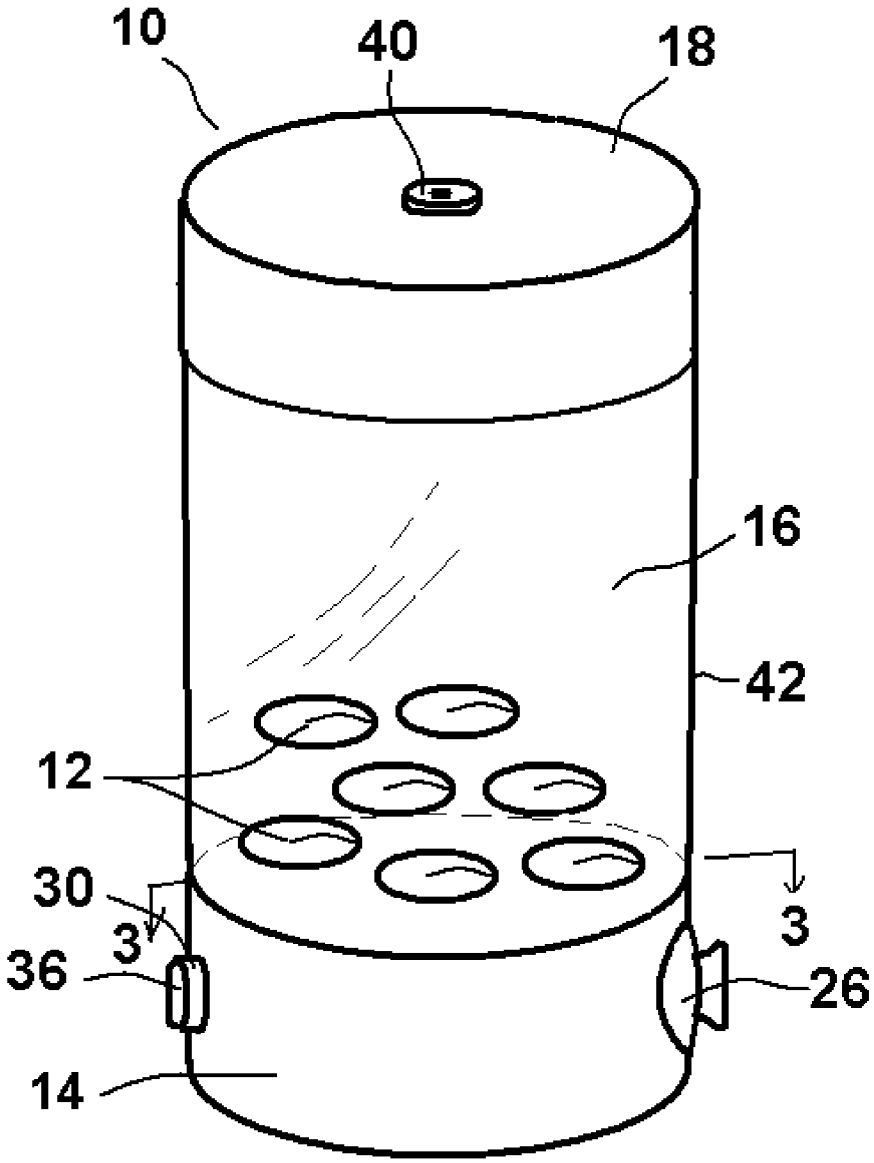
FIG. 1 is a perspective view of an exemplary embodiment of a container assembly.
Figure 2:
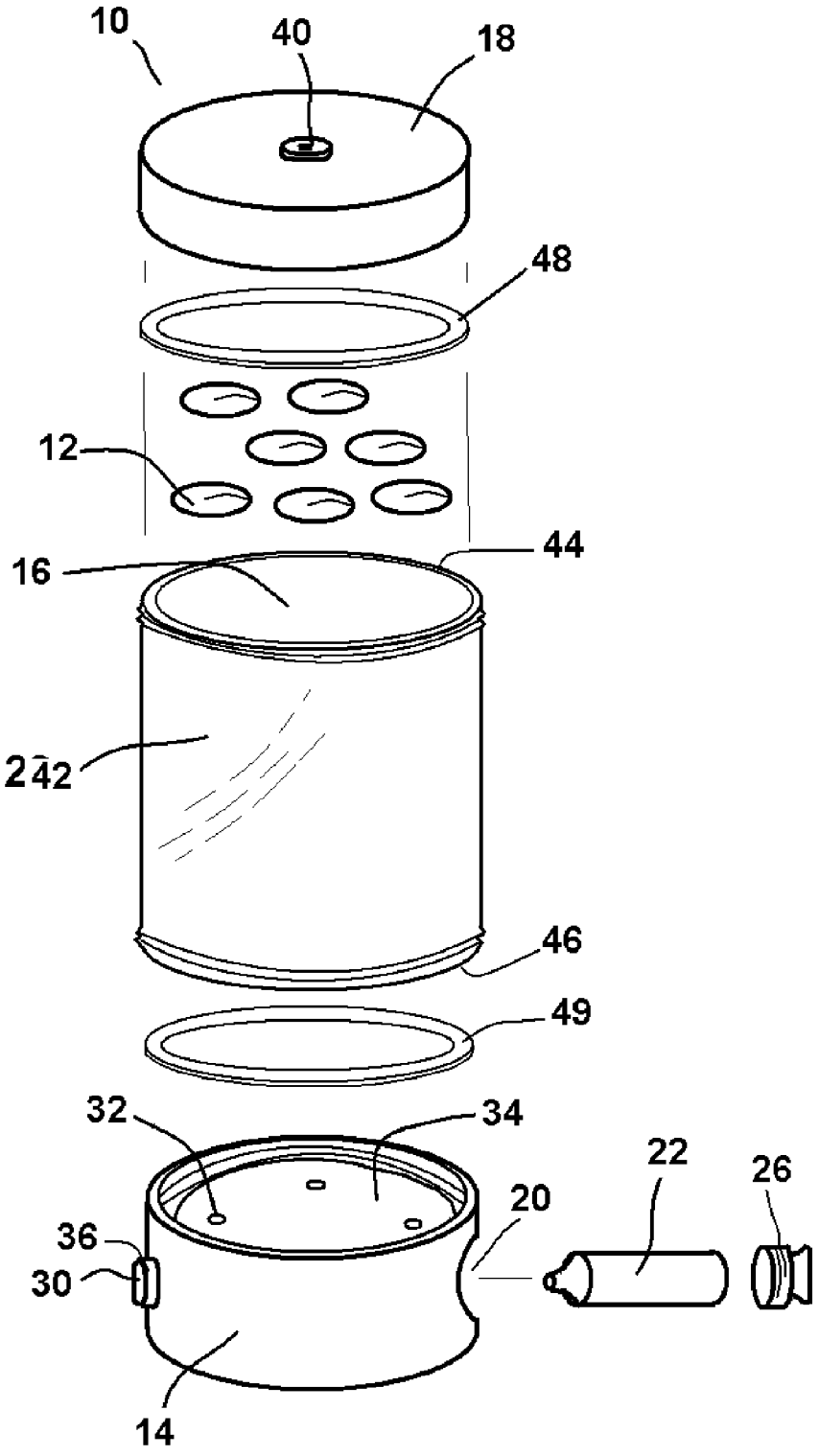
FIG. 2 is an exploded view of the exemplary embodiment of FIG. 1.

Referring to both FIG. 1 and FIG. 2, a container assembly 10 is shown. The container assembly 10 can be used to hold many perishable items 12 that are aversely affected by exposure to air and/or oxygen. In the exemplary embodiment being shown, the perishable items 12 being held are coffee beans. The coffee beans illustrated are full roasted coffee beans. However, it should be understood that the coffee could be ground. The container assembly 12 is preferably sized to hold at least one pound of coffee, in either bean form or ground form.

The container assembly 12 has three main sections. The main sections include a base 14, a storage area 16 and a closure 18. The perishable items 12 are stored in the storage area 16 between the base 14 and the closure 18. The closure 18 is selectively removable so that the perishable items 12 can be selectively added to, or removed from, the storage area 16. The structure of the storage area 16 is preferably transparent so that the perishable items 12 inside the container assembly 10 can be observed from outside the container assembly 10.

However, the storage area 16 need not be transparent and can be made of opaque materials, such as stainless steel or aluminum.

The base 14 of the container assembly 10 holds a gas charging system that has the ability to inject an inert gas into the interior of the storage area 16. The inert gas displaces air out of the storage area 16. The result is that any perishable items 12 in the storage area 16 now exist in an inert environment that is devoid of oxygen. The perishable items 12 cannot oxidize and, therefore, last longer without becoming stale.

Figure 3:
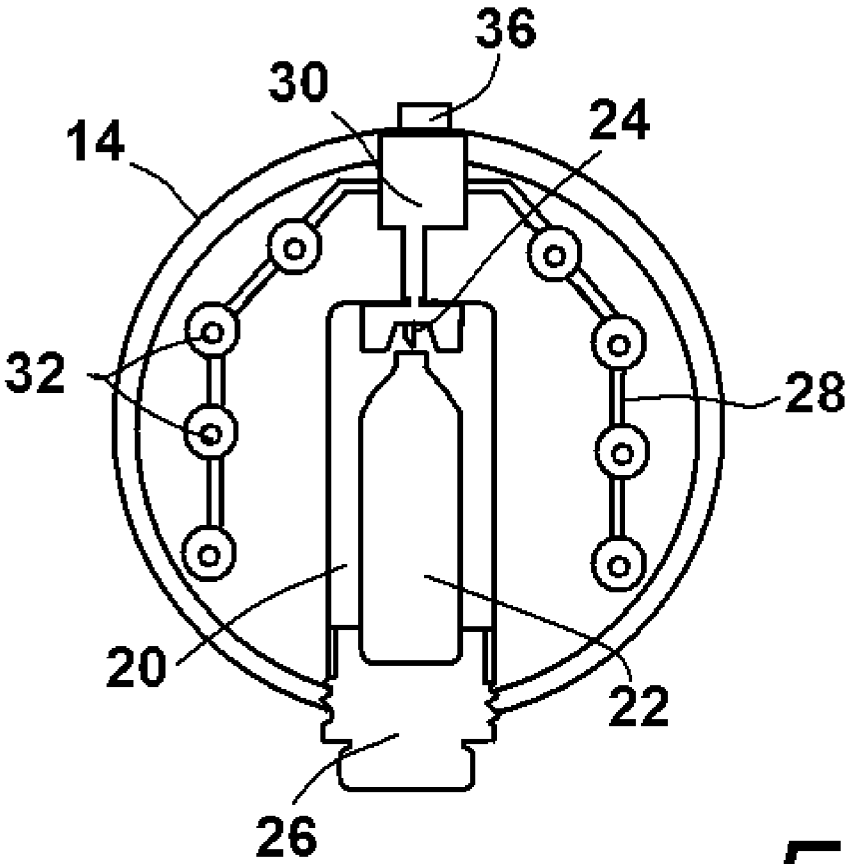
FIG. 3 is a cross-sectional view of the base of the exemplary embodiment of FIG. 1, viewed along section line 3-3.

Referring to FIG. 3 in conjunction with FIG. 1 and FIG. 2, it can be seen that a receptacle 20 is formed in the base 14 of the container assembly 10. The receptacle 20 is sized to receive a disposable gas cartridge 22. The gas cartridge 22 is preferably a twelve-gram carbon dioxide cartridge. However, smaller and larger cartridges may be used. Although carbon dioxide cartridges are preferred due to their low cost and wide availability, other inert gas cartridges, such as argon gas cartridges and nitrogen gas cartridges, can also be used. The gas cartridge 22 is placed into the receptacle 20. At one end of the receptacle 20 is a sharpened piercing projection 24, assuming that the gas cartridge 22 is a pierce-to-open cartridge. The receptacle 20 has a threaded open end. A bias cap 26 is provided that partially extends into the receptacle 20. The bias cap 26 engages the receptacle 20 with a threaded interconnection and advances into the receptacle 20 as the threaded interconnection is tightened. As the bias cap 26 is threaded into the receptacle 20, the bias cap 26 engages the gas cartridge 22 and forces the gas cartridge 22 against the piercing projection 24. As the bias cap 26 seals the receptacle 20, the gas cartridge 22 is caused to be breached by the piercing projection 24. If a gas cartridge is used that has a thread-to-use valve, the receptacle 20 can be fit with a threaded port to receive the gas cartridge.

Once the gas cartridge 22 is opened, gas from within the gas cartridge 22 is released. The gas enters the distribution manifold 28 that is regulated by a press button fill valve 30. The distribution manifold 28 has conduits that connect a plurality of gas ports 32 to the fill valve 30. The gas ports 32 are distributed across a top surface 34 of the base 14. The fill valve 30 is normally in a "closed" condition. That is, when left alone, the fill valve 30 is closed and does not enable gas from the gas cartridge 22 to flow into the distribution manifold 28. However, the fill valve 30 has a push button actuator 36 that is accessible on the side exterior of the base 14. When the push button actuator 36 is manually pressed, the fill valve 30 changes from a closed condition to an open condition. When in its open condition, the fill valve 30 enables gas to flow from the gas cartridge 22 into the distribution manifold 28. Once the gas enters the distribution manifold 28, the gas flows through the gas ports 32 and begins to fill the storage area 16 above the base 14. If the gas is carbon dioxide, the gas is heavier than air. As such, the gas entering the storage area 16 will collect toward the bottom of the storage area 16, displacing the air to the top of the storage area 16.

The top of the storage area 16 is selectively sealed with the closure 18 of the container assembly 10. A pressure release valve 40 is provided in the closure 18. The pressure release valve 40 is a one-way valve that enables gas from within the storage area 16 to exit through the closure 18, provided the pressure in the storage area 16 surpasses the surrounding ambient pressure.

The storage area 16 is defined by a tubular wall 42 having an open top end 44 and an open bottom end 46. The open top end 44 is threaded so that it can engage the closure 18 with a threaded interconnection. An O-ring seal 48 is set into the closure 18 so that the closure 18 can engage the open top end 44 of the tubular wall 42 with an airtight seal.

Likewise, the open bottom end 46 of the tubular wall 42 is also threaded. This enables the open bottom end 46 of the tubular wall 42 to engage the base 14 with a threaded connection. An O-ring seal 49 is set into the base 14 so that the open bottom end 46 of the tubular wall 42 can engage the base 14 with an airtight seal. The tubular wall 42 can be manufactured as a structure that is permanently affixed to the base 14. However, a detachable base/tubular wall assembly is preferred in order to make both items easier to clean.

The tubular wall 42 serves as the peripheral wall of the storage area 16. The top surface 34 of the base 14 serves as the bottom surface of the storage area 16. Lastly, the closure 18 serves as the top of the storage area 16. To utilize the container assembly 10, the closure 18 is removed. A volume of perishable items 12 are then placed into the storage area 16. The closure 18 is reattached over the storage area 16 to encapsulate and isolate the perishable items 12 within the storage area 16.

A gas cartridge 22 is placed into the receptacle 20 in the base 14. The gas cartridge 22 is seated and pierced in the receptacle 20. Once charged with gas from the gas cartridge 22, the fill valve 30 is manually activated. The fill valve 30 releases gas from the gas cartridge 22 into the storage area 16 through the gas ports 32 in the base 14. As gas from the gas cartridge 22 flows into the storage area 16, the air that was in the storage area 16 is displaced out of the storage area 16 through the release valve 40. The result is that the perishable items 12 within the storage area 16 become flooded with gas from the gas cartridge 22.

The gas is introduced into the storage area 16 at the bottom of the storage area 16. Furthermore, the gas is introduced from multiple gas ports 32 across the bottom of the storage area 16. This wide bottom dispersement ensures that very little air remains trapped amongst the perishable items 12, even if the perishable items 12 are finely ground coffee. Furthermore, the introduction of the gas into the storage area 16 tends to physically stir loose items, such as ground coffee. This displaces trapped air and ensures that most all trapped air is displaced in favor of the incoming inert gas.

The gas from the gas cartridge 22 is an inert gas, such as carbon dioxide, nitrogen, or argon. By flooding the perishable items 12 with such an inert gas, the perishable items 12 become deprived of oxygen. The lack of oxygen prevents the compounds within the perishable items 12 from oxidizing. The result is that the perishable items 12 remain fresher longer.

To remove the perishable items 12 from the storage area 16, the closure 18 is simply removed and the perishable items 12 are poured out of the storage area 16. This only temporarily contaminates the interior of the storage area 16 with air. Once the closure 18 is seated back in place, the fill valve 30 is again activated so that the storage area 16 is once more flooded with inert gas. A single gas cartridge 22 is capable of recharging the storage area multiple times before it needs to be replaced.

It will be understood that the embodiment of the present invention that is illustrated and described is merely exemplary and that a person skilled in the art can make many variations to that embodiment. All such alternate embodiments are intended to be included within the scope of the present invention as defined by the claims as filed.

What is claimed is:

1. A container assembly, comprising:

a base having a side surface and a top surface with at least one gas port formed in said top surface;

a gas charging system disposed within said base, wherein said gas charging system includes a piercing projection for piercing a gas cartridge, a distribution manifold that leads from said piercing projection to said at least one gas port, and a fill valve for selectively controlling gas flow through said distribution manifold, wherein said fill valve has a push button control that is exposed on said side surface of said base;

a tubular wall affixed to said base and extending above said top surface of said base to define a storage compartment, said tubular wall having an open top end;

a removable closure selectively attachable to said open top end of said tubular wall; and a release valve that enables gas to exit said storage compartment.

2. The assembly according to claim 1, wherein said release valve is disposed in said closure.

3. The assembly according to claim 1, wherein said tubular wall is transparent and enables said storage compartment to be viewed through said tubular wall.

4. The assembly according to claim 1, wherein said tubular wall interconnects with said base with a threaded connection.

5. The assembly according to claim 1, wherein said closure engages said tubular wall with a threaded connection.

6. The assembly according to claim 1, wherein said storage compartment has a volume large enough to hold one pound of coffee beans.

7. The assembly according to claim 1, wherein said at least one gas port is configured to include a plurality of dispersed gas ports.

8. The assembly according to claim 1, wherein said gas charging system includes a threaded element that engages said base and biases an inserted gas cartridge against said piercing projection.

9. A container assembly, comprising:

a storage container having an open top;

a closure for selectively closing said open top, wherein said storage container has a transparent peripheral wall that enables said storage container to be viewed therethrough and wherein said closure engages said peripheral wall with a threaded connection;

at least one gas port that leads into said storage container;

a receptacle for receiving a gas cartridge;

a piercing projection for piercing said gas cartridge within said receptacle;

distribution manifold for directing gas from said piercing projection to said at least one gas port; and a fill valve for selectively controlling gas flow between said piercing projection and said at least one gas port.

10. The container assembly according to claim 9, wherein said storage container includes a base having a top surface, wherein said at least one gas port is disposed in said top surface of said base.

11. The assembly according to claim 10, wherein said receptacle is disposed in said base.

12. The assembly according to claim 9, further including a release valve for enabling gas to exit said storage container.

13. The assembly according to claim 12, wherein said release valve is disposed in said closure.

14. The assembly according to claim 9, wherein said peripheral wall interconnects with said base with a threaded connection.

15. The assembly according to claim 10, wherein said at least one gas port is configured to include a plurality of dispersed gas ports.

16. The assembly according to claim 10, wherein said base has a side surface and said fill valve has a push button control that is exposed on said side surface of said base.

17. The assembly according to claim 10, wherein said receptacle has a threaded cap that engages said base and biases an inserted gas cartridge against said piercing projection.

18. A container assembly, comprising:

a storage container having an open top and a base, wherein said base has a top surface;

a closure for selectively closing said open top, wherein said storage container has a peripheral wall that enables said storage container to be viewed therethrough and wherein said peripheral wall engages said base with a threaded connection;

at least one gas port that leads into said storage container through said base;

a receptacle for receiving a gas cartridge;

a piercing projection for piercing said gas cartridge within said receptacle;

at least one conduit for directing gas from said piercing projection to said at least one gas port; and a fill valve for selectively controlling gas flow between said piercing projection and said at least one gas port.

* * * * *